US006545429B1

(12) United States Patent
Flory, IV

(10) Patent No.: US 6,545,429 B1
(45) Date of Patent: Apr. 8, 2003

(54) LIGHTING ASSEMBLY HAVING REGULATING TRANSFORMER DISTALLY LOCATED FROM BALLAST

(75) Inventor: Isaac L. Flory, IV, Blacksburg, VA (US)

(73) Assignee: Hubbell Incorporated, Orange, CT (US)

( * ) Notice: Subject to any disclaimer, the term of this patent is extended or adjusted under 35 U.S.C. 154(b) by 0 days.

(21) Appl. No.: 09/589,192

(22) Filed: Jun. 8, 2000

(51) Int. Cl.[7] ..... G05F 1/00

(52) U.S. Cl. ..... 315/291; 315/248; 315/276; 315/282; 315/283; 315/57

(58) Field of Search ..... 315/291, 307, 315/248, 276, 278, 282, 283, DIG. 2, DIG. 5, 56, 57, 70; 323/355; 336/65

(56) References Cited

U.S. PATENT DOCUMENTS 4,902,942 A * 2/1990 El-Hamamsy ..... 315/276
4,959,593 A * 9/1990 Joanino ..... 315/DIG. 7
5,451,843 A * 9/1995 Kahn et al. ..... 315/291
5,663,612 A 9/1997 Nuckolls ..... 315/240
5,808,450 A * 9/1998 Chula et al. ..... 322/22
5,820,252 A * 10/1998 Finch ..... 362/265
5,825,139 A 10/1998 Nuckolls et al. ..... 315/307
5,892,336 A * 4/1999 Lin et al. ..... 315/291
5,932,976 A * 8/1999 Maheshwari et al. ..... 315/307
5,939,838 A * 8/1999 Janik ..... 315/291
6,066,921 A * 5/2000 Nakamura et al. ..... 315/56
6,091,208 A * 7/2000 Flory, IV ..... 315/276
6,160,353 A * 12/2000 Mancuso ..... 250/205
6,323,603 B1 * 11/2001 Persson ..... 315/209 CD

* cited by examiner

*Primary Examiner*—Don Wong
*Assistant Examiner*—Thuy Vinh Tran

(57) ABSTRACT

A gas discharge lamp assembly is provided wherein the regulator housing and the ballast housing are placed remote from each other. Further, an ignitor and a capacitor are added to the circuitry of the ballast housing to allow for the regulator's remote placement. Such gas discharge lamps are typically between 1000 Watts and 2000 Watts.

15 Claims, 5 Drawing Sheets

LIGHTING ASSEMBLY HAVING REGULATING TRANSFORMER DISTALLY LOCATED FROM BALLAST

FIELD OF THE INVENTION

The present invention relates to a lamp ballasting approach wherein the regulating device is placed in a remote location with respect to the ballast and lamp assembly.

BACKGROUND OF THE INVENTION

FIG. 1 depicts the equivalent circuit of a magnetically regulating lighting assembly 10 comprising a lamp 18, a ballast 14, and a regulating transformer 12 enclosed in a housing 16 which is typically used for H.I.D. (High intensity discharge) applications below the 1000 Watt level. These discharge lamps, below the 1000 Watt level, do not exhibit the overall performance desired for some lighting applications such as illumination of sports arenas, large industrial facilities and roadways where fixtures are elevated and/or spaced far apart. In such applications, a higher wattage lamp is desired. Such lamps, however, are not able to be ballasted in the manner shown in FIG. 1. The size and weight of the ballast limits its ability to fit within most ballast housings and would result in a heavy lighting assembly creating a moment arm about the support pole.

Another disadvantage of magnetically regualting ballasts is excessive heat loss. Such systems are not desirable in high temperature environments because of the undesirable amount of heat dissipated by the ballast 16. Accordingly, the size of the lamp (i.e. the wattage) is limited. There are applications, described below, wherein a higher wattage luminaire would be useful; however, such luminaires cannot be employed due to the significant heat loss of the ballast 16.

SUMMARY OF THE INVENTION

An object of the present invention is to provide a system and method for powering a lighting device where one unit, containing the ballast, is proximate to the first end of a support structure, and a second unit containing the regulating transformer is distal to the first end and proximate to the support structure.

Another object of the present invention is to provide a housing containing the regulating transformer which is connected to a power supply and to a remotely located second housing enclosing the lamp and ballast.

Still another object of the present invention is to provide a system that employs a second housing containing a ballast, an ignitor, and a capacitor that provides a low impedance path for the ignitor to prevent excessive attenuation to the ignitor pulse.

BRIEF DESCRIPTION OF THE DRAWINGS

These and other objects, advantages and novel features of the invention will be more readily appreciated from the following detailed description when read in conjunction with the accompanying drawings, in which.

DETAILED DESCRIPTION OF THE PREFERRED EMBODIMENT

Figure 1:
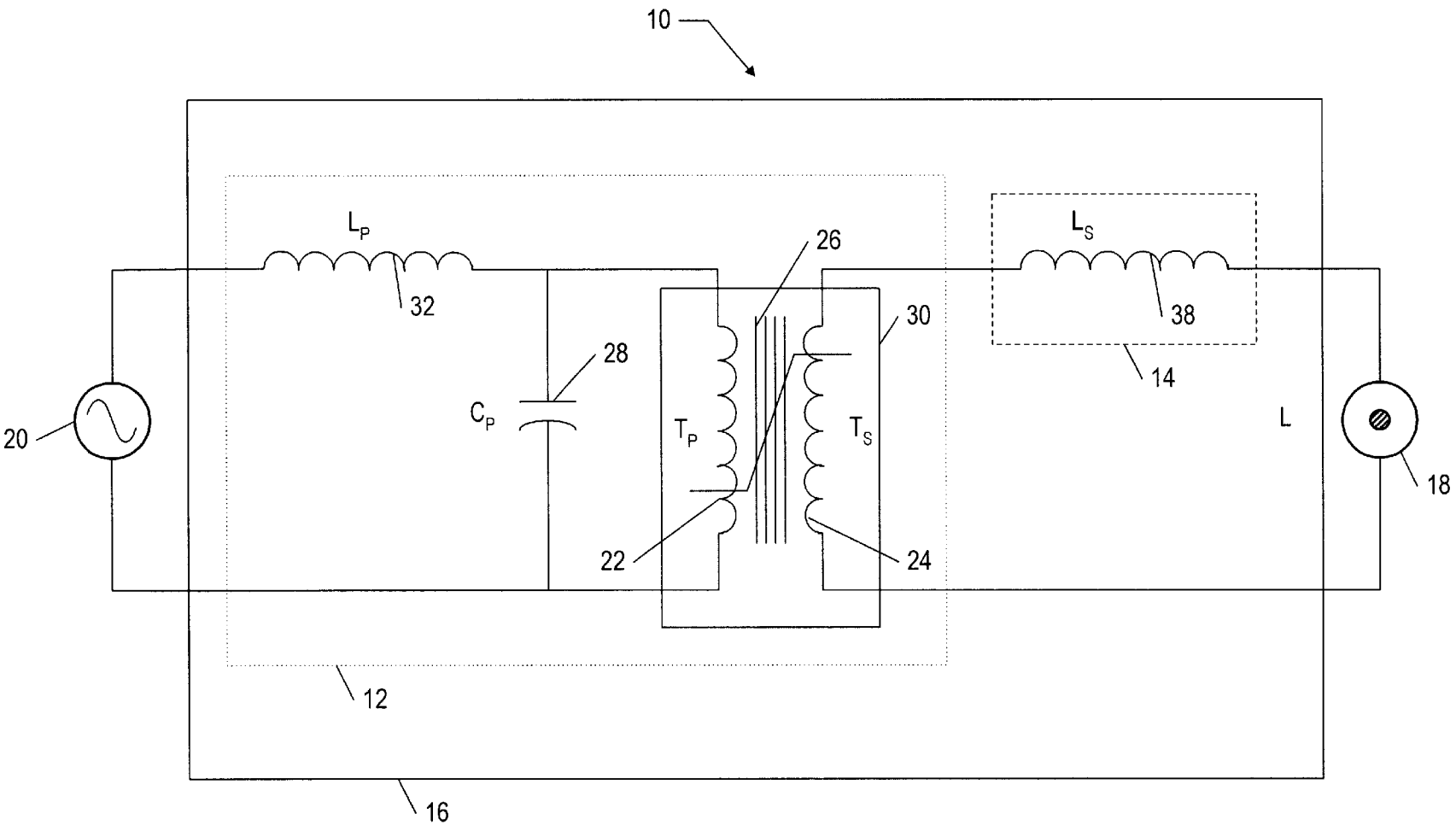
FIG. 1 (PRIOR ART)
FIG. 1 is a schematic circuit diagram for a lighting assembly.

As shown in FIG. 1, a magnetically regulating lighting assembly 10 comprises a lamp 18, and a magnetically regulating ballast assembly consisting of a conventional regulating transformer portion 12, and an inductive ballast 14, which are constructed on the same magnetic frame. This lighting assembly is enclosed in a single housing 16.

Figure 2:
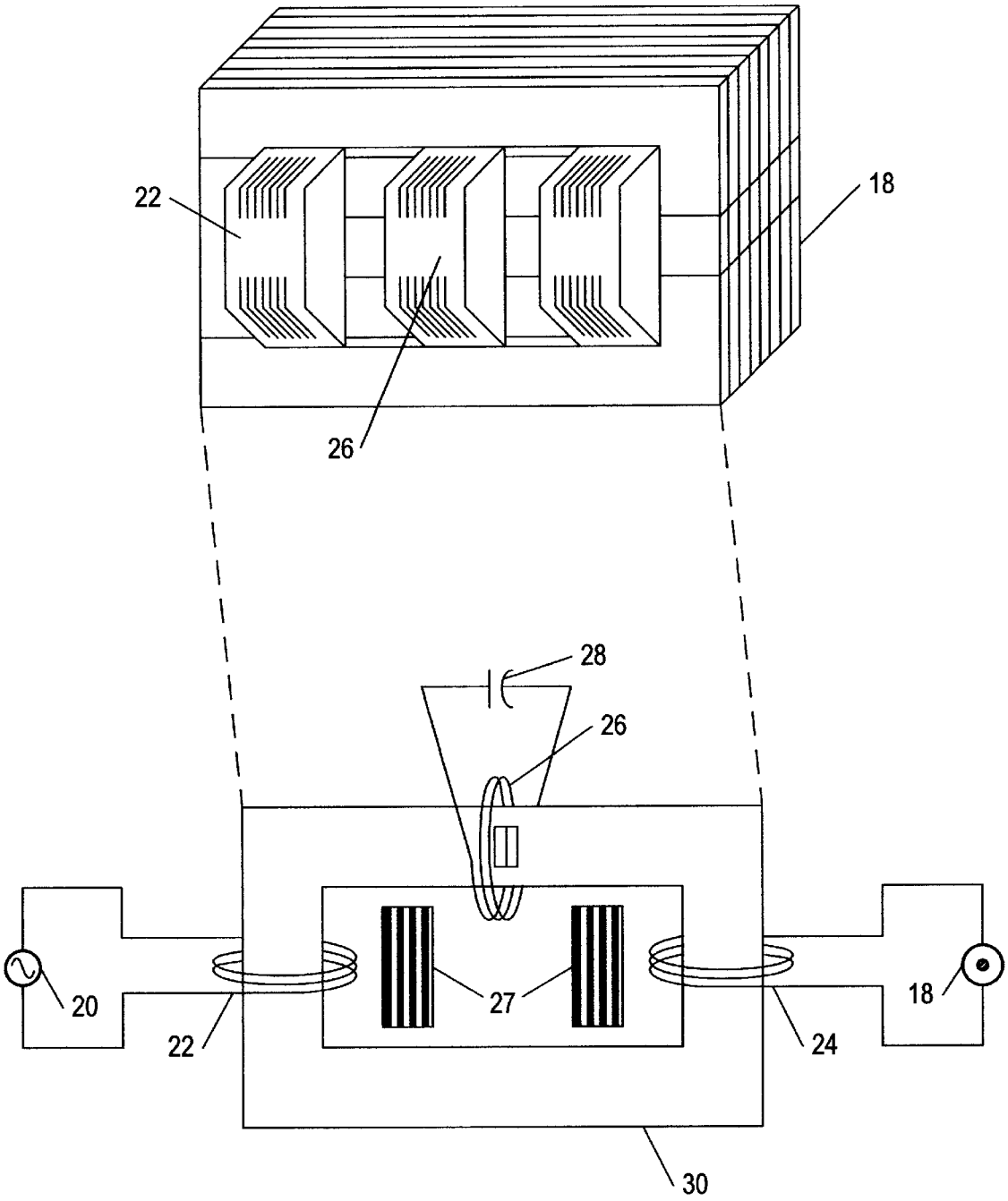
FIG. 2 (PRIOR ART)
FIG. 2 illustrates a conventional electromagnetic regulating transformer ballast structure.

As shown in FIG. 2, the regulating ballast 16 consists of the power supply 20 connected to the primary coil 22, a secondary winding 24, and a tertiary winding 26. Further, the tertiary winding 26 has a capacitor 28 connected in parallel. The three windings are coupled together by a laminated core 30. Referring back to FIG. 1 the alternating current power source 20 is connected across the primary winding 22 of the regulating transformer portion 12 of ballast 16. Equivalently, an inductor 32 is connected in series between the primary winding 22 and the power source 20. The capacitor 28 is shown in parallel with respect to the primary winding 22. The inductor 32 and the capacitor 28 are sized such that the peak voltage across capacitor 28 is in excess of the level necessary to drive the transformer, consisting of primary winding 22, the secondary winding 24, and a core 30, into saturation. As this saturation level is exceeded, the output waveform of the regulating transformer 12 exhibits a square-wave characteristic. As the input voltage is increased, the level of saturation is increased, resulting in a more distorted or "flattened" secondary voltage. A magnetically-regulated ballast system is provided when this secondary voltage is used to supply a reactor ballast 14 and lamp 18.

Such a lighting ballast assembly 16 is heavy relative to other ballast types that operate lamps of equivalent wattage. A 400 watt magnetically regulating ballast 16 can weigh approximately 26 pounds. An equivalent 1000 watt system can weigh on the order of 47.5 pounds, and an equivalent 1500 watt system can weigh at least 67.8 pounds. In these later two cases, it is difficult to mount these assemblies 10 within an existing lighting system. To employ these higher wattage lamps, there is a need to separate the regulating transformer 12, which represents most of the weight in the lighting assembly 10, from the ballasting function 14. The ability to have the regulating transformer 12 remote from the ballasting function 14 allows for more stable placement of the regulating transformer 12, and easier accessibility for maintenance. Further, one regulator 12 can be used to serve multiple lighting ballast assemblies 14 and lamps 18.

Figure 3:
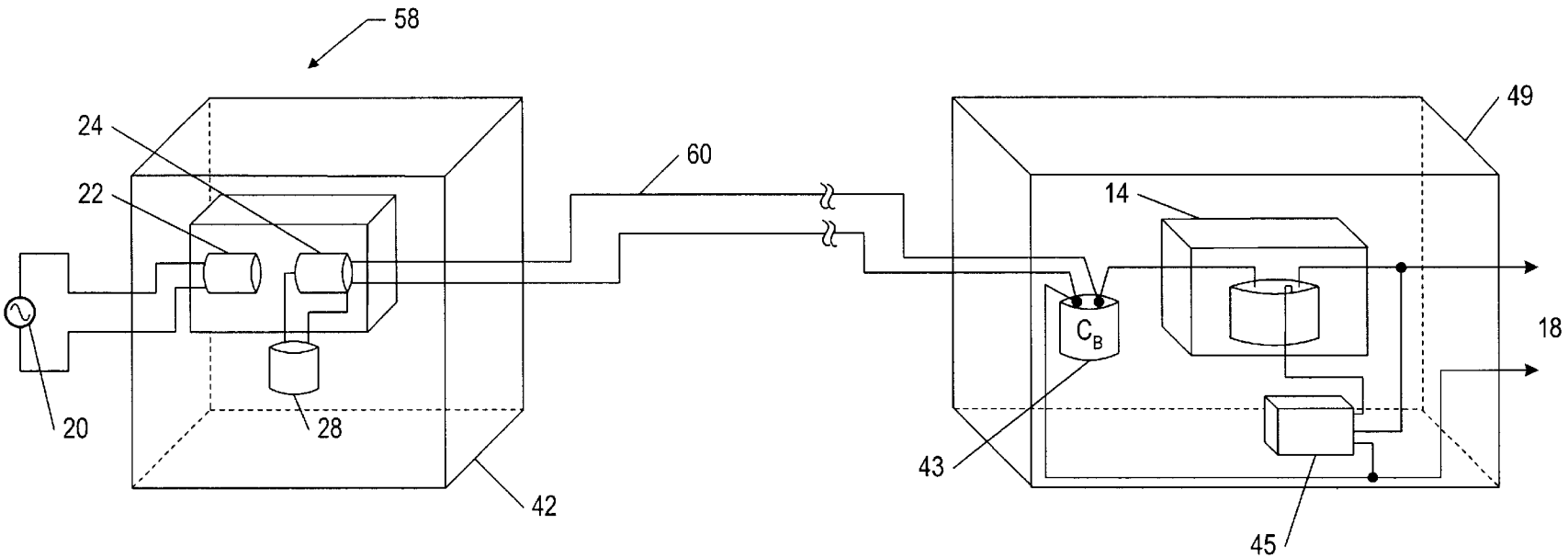
FIG. 3 is a schematic diagram of a lighting assembly constructed in accordance with an embodiment of the present invention.
Figure 4:
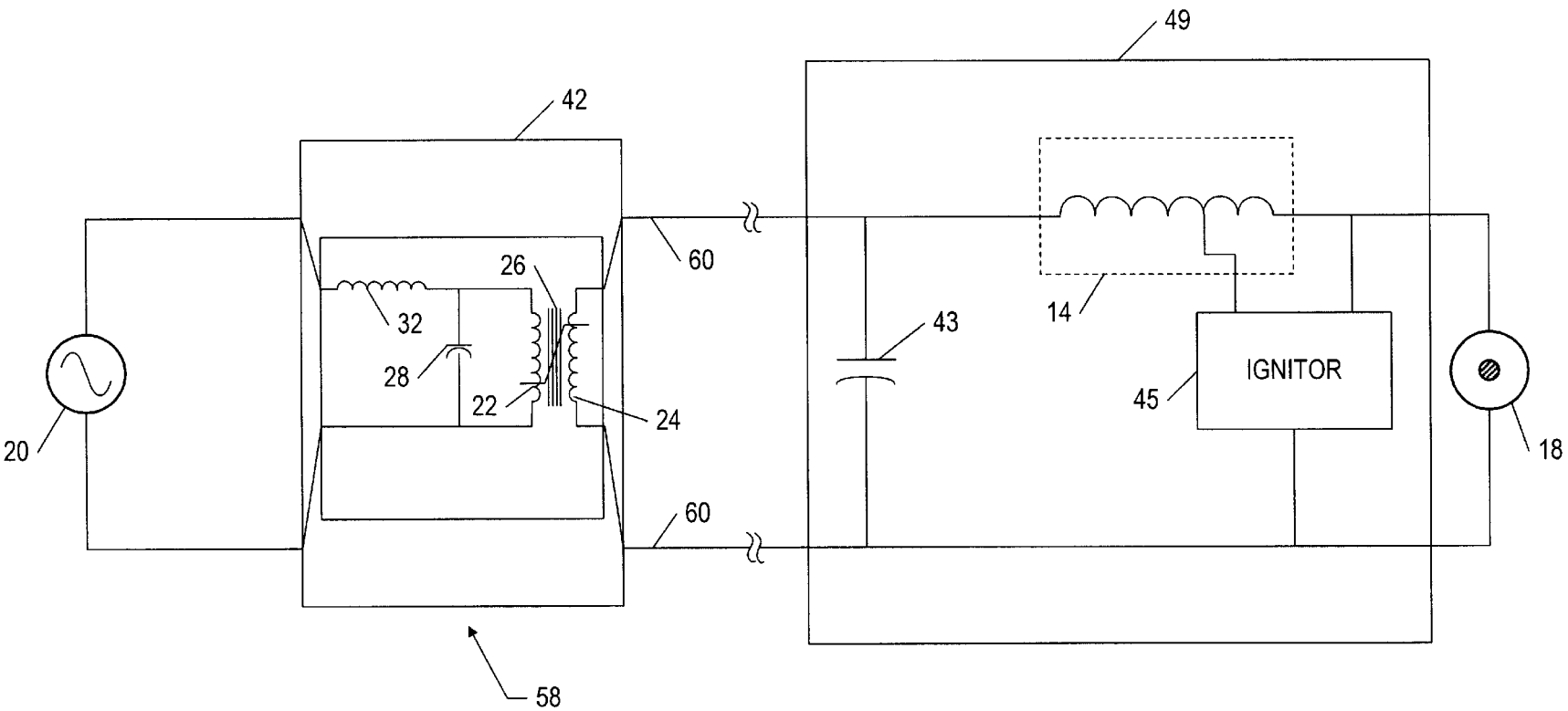
FIG. 4 is a schematic diagram of a lighting assembly constructed in accordance with an embodiment of the present invention.
Figure 5:
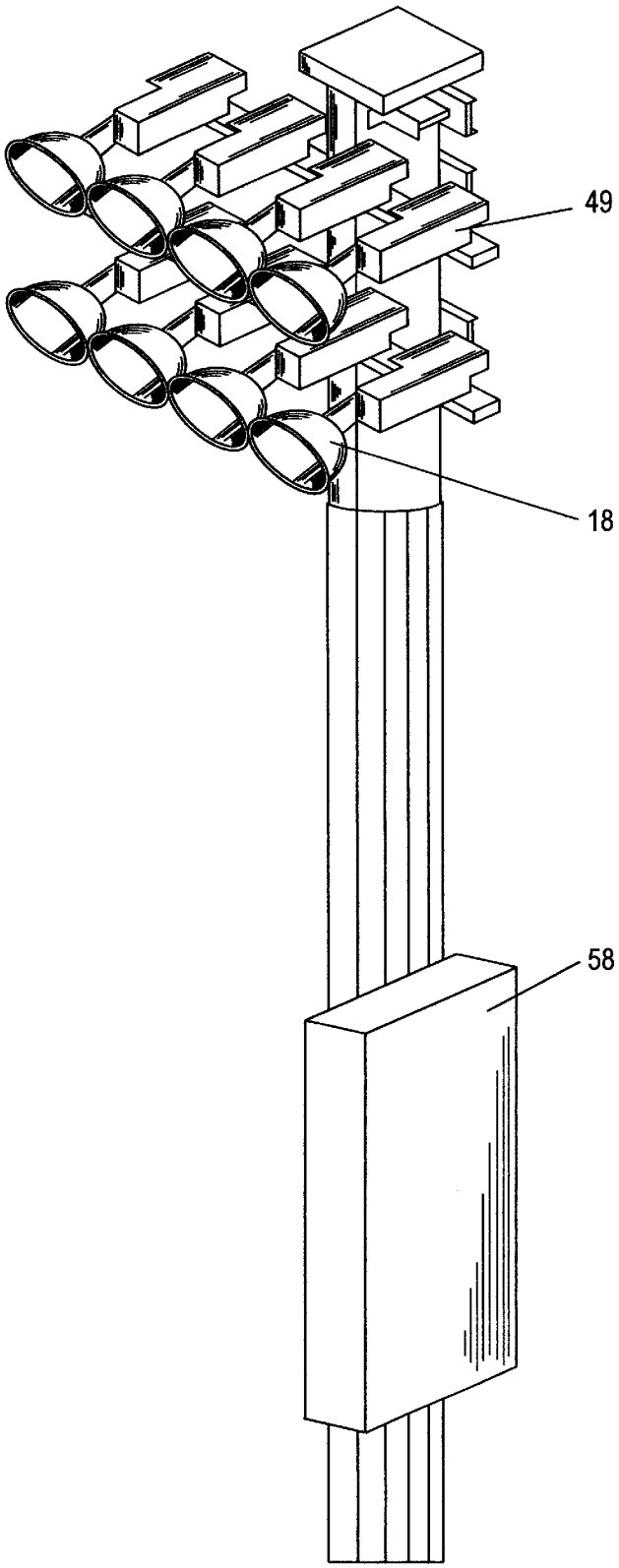
FIG. 5 depicts an elevated lighting assembly constructed in accordance with an embodiment of the present invention.

The present invention provides for remote placement of the regulating transformer 12 with respect to the ballast 14, as shown in FIGS. 3 and 4. With reference to the circuit diagram of FIG. 4, a regulating transformer 58 constructed in accordance with an embodiment of the present invention is similar to the regulating transformer 12 described above, except that it is preferably enclosed in a housing 42 that is independent of a housing 49 enclosing the ballast function 14. FIG. 3 depicts the separate housings 42 and 49, and wiring 60 therebetween. The wiring 60 is sized to minimize the voltage drop associated with the distance between the housings.

The ballast housing 49 has additional higher capacity circuitry to allow for higher wattage lamps 18 due to remote placement of transformer 58. More specifically in FIG. 4, an ignitor 45 and capacitor 43 are added in parallel with the regard to ballast 14 and ignitor 45, within the second housing 49. The ignitor 45 is provided for pulse starting. Since the ignitor 45 is added, a capacitor 43 is preferably provided to create a low impedance path to prevent excessive attenuation of the ignitor pulse.

The tables below illustrate an improvement in performance of the regulating transformer and reactor with the addition of capacitor 43 by providing more consistent lamp color and illumination level over variations in supply voltage, as well as a decrease in the degradation of the light output over the life of the lamp.

TABLE 1

Industry Standard Continuous Wattage Autotransformer (CWA)

| Nominal Volts Input = 277 VAC INPUT | | | | | Regulation = ± 10% OUTPUT | | | | |
|---|---|---|---|---|---|---|---|---|---|
| V | A | W | PF | THD | V | A | W | CF | REG |
| 277 | 1.67 | 447 | .964 | 18.1 | 140.1 | 3.11 | 386.9 | 1.62 | N/A |
| 304.7 | 1.69 | 495.5 | .959 | 27.5 | 141.3 | 3.36 | 422.6 | 1.61 | +9.2% |
| 249.3 | 1.59 | 388.6 | .979 | 17.0 | 138 | 2.73 | 340.1 | 1.65 | −12.1% |

OCV: 240 rms/452 pk
SCA: 3.67 rms/6.43 pk

TABLE 2

Ballast 14 with capacitor 43

| Nominal Volts Input = 240 VAC INPUT | | | | | Regulation = ± 10% OUTPUT | | | | |
|---|---|---|---|---|---|---|---|---|---|
| V | A | W | PF | THD | V | A | W | CF | REG |
| 239.6 | 2.02 | 447.0 | .925 | 17.3 | 140.2 | 3.19 | 419.1 | 1.47 | N/A |
| 264.3 | 2.29 | 528 | .875 | 16.4 | 141.2 | 3.72 | 488.0 | 1.48 | +16.4% |
| 216.7 | 1.75 | 362.4 | .957 | 19.8 | 137.2 | 2.68 | 341.9 | 1.51 | −18.4% |

OCV: 241.5 rms/334.5 pk
SCA: 4.40 rms/6.10 pk

TABLE 3

Regulating Transformer 12 with out Capacitor 43

| Nominal Volts Input = 480 VAC INPUT | | | | | Regulation = ± 10% OUTPUT | | | | |
|---|---|---|---|---|---|---|---|---|---|
| V | A | W | PF | THD | V | A | W | CF | REG |
| 483.4 | 1.01 | 438 | .895 | 16.5 | 139.1 | 2.8 | 364 | 1.54 | N/A |
| 528.1 | 1.20 | 456 | .722 | 30.0 | 139.8 | 2.85 | 369.3 | 1.544 | +1.5% |
| 431.7 | .979 | 414.7 | .981 | 2.43 | 138.9 | 2.68 | 348 | 1.55 | −4.4% |

OCV: 257/rms/392 pk
SCA: N/A

TABLE 4

| Nominal Volts Input = 480 VAC INPUT | | | | | Regulation = ± 10% OUTPUT | | | | |
|---|---|---|---|---|---|---|---|---|---|
| V | A | W | PF | THD | V | A | W | CF | REG |
| 480.6 | 1.17 | 526.2 | .937 | 11.83 | 140 | 3.13 | 410 | 1.53 | N/A |
| 528.1 | 129 | 538.8 | .792 | 26.0 | 140.5 | 3.144 | 409.9 | 1.528 | +0% |
| 432 | 1.19 | 505.6 | .985 | 4.23 | 139.6 | 3.05 | 395.4 | 1.54 | −3.56% |

OCV: 257/rms/393 pk
SCA: 4.27 rms/5.76 pk

Tables 1 and 4 provide performance information for an industry standard continuous wattage autotransformer (CWA) and the lighting assembly 10 of the present invention, respectively. Specifically, comparing the REG columns (regulation function) of Tables 1 and 4 there is a smaller differential between the supply voltage and lamp power variations exhibited by the present invention. Similar to Table 1, Table 2 containing ballast 14 exhibits poor regulation, however this regulation improves by the addition of the regulating transformer 12, as can be seen in Table 4 of the present invention. The regulation function allows for consistency of color and illumination levels. Further, comparing the PF power factor and THD total harmonic distortion columns of Tables 3 and 4, the addition of capacitor 43 allows for a higher power factor correction and a reduction in total harmonic distortion. Tables 3 and 4 use nominal volt inputs of 480 VAC however, they use a stepped down transformer to a nominal 240 VAC. A comparison of column CF crest factor of Tables 2 and 4 shows a decrease in crest factor thus lessening the degradation of light output over the life of the luminaire.

While only one advantageous embodiment has been chosen to illustrate the invention, it will be understood by those skilled in the art that various changes and modifications can be made herein without departing from the scope of the invention as defined in the appended claims.

What is claimed is:

1. A system for powering at least one High Intensity Discharge or HID lighting device, wherein said lighting device is mounted proximate to a first end of a supporting structure, and distal to a second end of the supporting structure, said system comprising:

a first unit proximate to said HID lighting device comprising a ballast adapted to drive said HID lighting device;

a second unit coupled to said supporting structure distal from said first end and proximate to said second end, and comprising a regulating transformer adapted to power said ballast to cause said ballast to drive said HID lighting device; and wiring coupling said first unit and said second unit, wherein said wiring is operable to reduce a voltage drop between said regulating transformer and said ballast.

2. A system as claimed in claim 1, wherein said ballast is configured to operate said HID lighting device having an operating wattage greater than 400 Watts.

3. A system as claimed in claim 1, wherein said ballast is configured to operate said HID lighting device having an operating wattage selected from the group consisting of: 1000 Watts, 1500 Watts, 1650 Watts, and 2000 Watts, and from the range of 1000–2000 Watts.

4. A system as claimed in claim 1, further comprising a plurality of ballasts wherein said regulating transformer powers said plurality of said ballasts connected in parallel with each other, each of said plurality of ballasts being operable to drive at least one said HID lighting device.

5. A system for driving a lighting device as claimed in claim 1, wherein said transformer is a ferro-resonant regulating transformer.

6. A system as claimed in claim 1, wherein said second unit is located proximate to the ground.

7. A system for powering at least one High Intensity Discharge or HID lighting device, wherein said lighting device is mounted proximate to a first end of a supporting structure, and distal to a second end of the supporting structure, said system comprising:

a first unit proximate to said lighting device comprising a ballast adapted to drive said HID lighting device;

a second unit coupled to said supporting structure distal from said first end and proximate to said second end, and comprising a transformer adapted to power said ballast to cause said ballast to drive said HID lighting device;

wiring coupling said first unit and said second unit, wherein said wiring is operable to reduce a voltage drop between said transformer and said ballast; and an ignitor having a first terminal coupled to said ballast and said HID lighting device and a second terminal coupled to a capacitor and said HID lighting device.

8. The system as claimed in claim 7, said capacitor comprising:

a first terminal coupled to said ballast and said transformer; and a second terminal coupled to said transformer and said lighting device.

9. A method for powering at least one High Intensity Discharge or HID lighting device comprising the steps of:

providing current from an alternating current source to a regulating transformer located distal to said HID lighting device;

providing a voltage from said transformer to a serially connected ballast and said HID lighting device located remotely therefrom; and minimizing a voltage drop between said regulating transformer and said ballast.

10. A method for powering at least one High Intensity Discharge or HID lighting device comprising the steps of:

providing current from an alternating current source to a transformer located distal to said HID lighting device;

providing a voltage from said transformer to a serially connected ballast and HID lighting device located remotely therefrom;

minimizing a voltage drop between said transformer and said ballast; and generating starting pulses for said HID lighting device using an ignitor coupled to said ballast and across said HID lighting device.

11. A method as claimed in claim 10, wherein said generating step further comprises the step of reducing parasitic impacts from said ignitor to said transformer.

12. A method as claimed in claim 11, wherein said reducing step employs a capacitor connected across said driver device.

13. A system for powering at least one lighting device, wherein said lighting device is mounted proximate to a first end of a supporting structure, and distal to a second end of the supporting structure, said system comprising:

a first unit proximate to said lighting device comprising a ballast adapted to drive said lighting device;

a second unit coupled to said supporting structure distal from said first end and proximate to said second end, and comprising a regulating transformer adapted to power said ballast to cause said ballast to drive said lighting device;

wiring coupling said first unit and said second unit, wherein said wiring is operable to reduce a voltage drop between said regulating transformer and said ballast; and an ignitor located on said first unit, said ignitor operable to generate pulses to initiate said ballast, and said ignitor coupled to a capacitor operable to provide a low impedance path for said pulses.

14. A system for powering at least one lighting device as claimed in claim 13, wherein said ballast is configured to operate said lighting device having an operating wattage greater than 400 Watts.

15. A system for powering at least one lighting device as claimed in claim 13, wherein said ballast is configured to operate said lighting device having an operating wattage selected from the group consisting of: 1000 Watts, 1500 Watts, 1650 Watts, 2000 Watts, and from the range of 1000–2000 Watts.

* * * * *